US008876114B2

(12) United States Patent
Morrell

(10) Patent No.: US 8,876,114 B2
(45) Date of Patent: Nov. 4, 2014

(54) THREE-DIMENSIONAL ARCHERY TARGET

(76) Inventor: Dale A. Morrell, Alma, AR (US)

( * ) Notice: Subject to any disclaimer, the term of this patent is extended or adjusted under 35 U.S.C. 154(b) by 527 days.

(21) Appl. No.: 13/199,688

(22) Filed: Sep. 7, 2011

(65) Prior Publication Data

US 2012/0056380 A1 Mar. 8, 2012

Related U.S. Application Data

(60) Provisional application No. 61/402,768, filed on Sep. 7, 2010.

(51) Int. Cl.
*F41J 3/00* (2006.01)

(52) U.S. Cl.
CPC ..... *F41J 3/00* (2013.01)
USPC ..... 273/403

(58) Field of Classification Search
CPC ..... F41J 3/0004; F41J 1/00; F41J 1/10; A63F 9/0204; A01M 31/06
USPC ..... 273/403, 348; D21/302; D22/113, 125; 446/226, 331
See application file for complete search history.

(56) References Cited

U.S. PATENT DOCUMENTS 7,827,728 B1 * 11/2010 Spafford et al. ..... 43/2
2002/0145256 A1 * 10/2002 McKenzie et al. ..... 273/404

* cited by examiner

*Primary Examiner* — Gene Kim
*Assistant Examiner* — Amir Klayman
(74) *Attorney, Agent, or Firm* — Boyd D. Cox

(57) ABSTRACT

The present invention is a three-dimensional archery target that simulates an animal and has multiple primary target zones disposed on a central body section. A front end section which includes a head and a rear end section which includes a tail are interchangeably mounted on the central body section. Similarly, front and rear leg sections are also interchangeably mounted on the central body section so that the central body section can be selectively reversed, thereby changing the orientation of the animal's front to back on the target. By reversing the target's orientation, the designated primary target zones can be changed on the central body section, thereby extending the useable life of the archery target.

2 Claims, 7 Drawing Sheets

THREE-DIMENSIONAL ARCHERY TARGET

Priority for this application is claimed from U.S. Provisional Application No. 61/402,768 entitled "Three-Dimensional Archery Target" filed on Sep. 7, 2010

I. BACKGROUND

The present invention is directed to a three-dimensional archery target that simulates an animal and has multiple primary target zones on a central body section. A front section which comprises a head and a rear section which comprises a tail are interchangeably mounted on the central body section. First and second leg sections are also interchangeably mounted on the central body section so that the front and rear of the central body section can be selectively reversed.

Due to the challenges of bow hunting, it can be advantageous for an archer to hone his or her skills by practicing with a life-like target. It is believed that practicing with a three-dimensional target that simulates a hunter's prey can stimulate the hunter's response in a hunting situation. This can thereby increase the hunter's probability of success in a hunting endeavor.

When shooting, an archer will aim for an area on the prey that is most likely to debilitate and kill the animal. For example, on a deer, the vital target area is generally the heart and lungs. Therefore, when practicing with a target simulating a deer, the vital target area is in the lower chest. Consequently, since the lower chest area is a vital target area, it is more likely to be pierced by arrows during the course of a target-shooting session. Repeated hits and withdrawals of the practice arrows in the vital target area of the simulated animal can cause deterioration in that area at a much faster rate than the rest of the target and when the vital target area is destroyed the target is no longer useable for shooting practice.

In the prior art, the vital target areas of practice targets have been made of a material that is more durable than the rest of the target. Therefore, with a large portion of the target being made of a cheaper, less durable material and the vital target area made of a more durable material, the target can be manufactured at a lower cost and the vital target area holds up longer under use. However, the vital target areas of these targets eventually deteriorate from repeated penetration and withdrawal of arrows and in some cases, the entire target must be replaced.

Some other three-dimensional targets have replaceable inserts for the vital target areas, so that the vital target areas can be removed and replaced when they are damaged beyond use. Having replaceable inserts enables this small area of the target to be continuously replaced while the bulk of the target can remain intact. However, each time the vital target area becomes unusable, it is necessary to stop and replace the insert. Such a procedure is cumbersome and takes time away from the archer's practice time.

The prior art also includes three-dimensional targets having multiple vital target areas on the target. However, these three-dimensional targets do not resemble an actual animal, but rather comprise a target having two heads and two chest areas. Each of the chest areas includes a vital target area. The hunter can alternate between the two vital target areas when practicing. However, since the target does not simulate an actual animal, a hunter's natural response can be diminished in the field when exposed to the prey.

Therefore, there is a need for a three-dimensional hunting target that simulates a live animal and that has multiple vital target areas on the target itself to extend the life of the target.

There is also a need for a three-dimensional deer hunting target that can alternate between simulating a buck or a doe.

II. SUMMARY

A three-dimensional archery target is comprised of a central body section, interchangeable leg and end sections and removable head accessories. Each of the left and right sides of the central body section includes a primary target zone. Each primary target zone includes a pair of marked target areas that can be situated in the direct kill zone of the simulated animal. The interchangeable end sections include a front section comprising a head, and a rear section comprising a tail. The interchangeable leg sections comprise a first leg section and a second leg section. By interchanging the front section and the rear section on the central body section along with the first and second leg sections, the primary target zone on the central body section of the target can be readily alternated for target practice, thereby maintaining a life-like target and extending the useable life of the archery target. In addition, an archer can alternate between using the target zone on the left and right sides of the central body section, further increasing the life of the archery target.

It is an object of the present invention to provide a three-dimensional archery target having more than one primary target zone.

It is a further object of the present invention to provide a three-dimensional archery target that has multiple primary target areas and that simulates the appearance of a live animal.

It is a further object of the present invention to provide a three-dimensional archery target having interchangeable accessory sections.

It is a further object of the present invention to provide a three-dimensional archery target having an extended useable life.

It is a further object of the present invention to provide a three-dimensional archery target having interchangeable front and rear sections.

It is a further object of the present invention to provide a three-dimensional archery target that simulates an animal and has alternating "kill" zones.

It is a further object of the present invention to provide a three-dimensional deer archery target that can alternatively simulate a buck or a doe.

It is a further object of the present invention to provide a three-dimensional archery target having interchangeable first and second leg sections.

It is a further object of the present invention to provide a three-dimensional archery target having a primary target zone on each side of the archery target.

III. BRIEF DESCRIPTION OF THE DRAWINGS

Reference is made to the accompanying drawings in which are shown illustrative embodiments of the invention and from which novel features and advantages will be apparent.

IV. DETAILED DESCRIPTION

Figure 1:
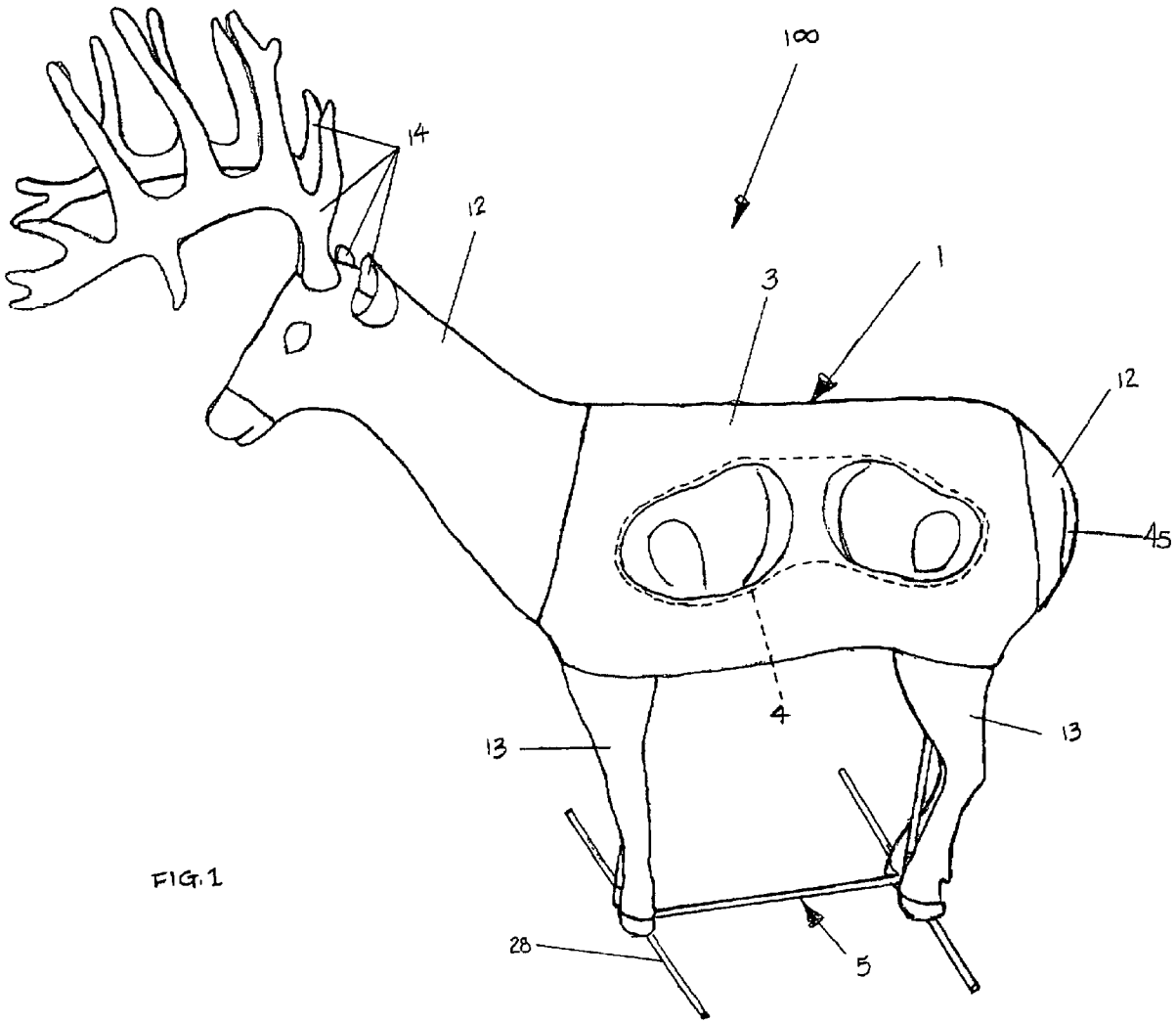
FIG. 1 is a perspective view of a first embodiment of the three-dimensional archery target of the present invention having a front section that simulates a buck.

The three-dimensional archery target (100) of the present invention comprises a target body (1) and a body support (5) in FIG. 1. The target body (1) includes a plurality of target body segments (2) and a plurality of primary target zones (4) as shown in FIGS. 1 and 2.

The target body segments (2) include a central body section (3), a plurality of interchangeable end sections (12), a plurality of interchangeable leg sections (13) and a plurality of removable head accessories (14).

Figure 2:
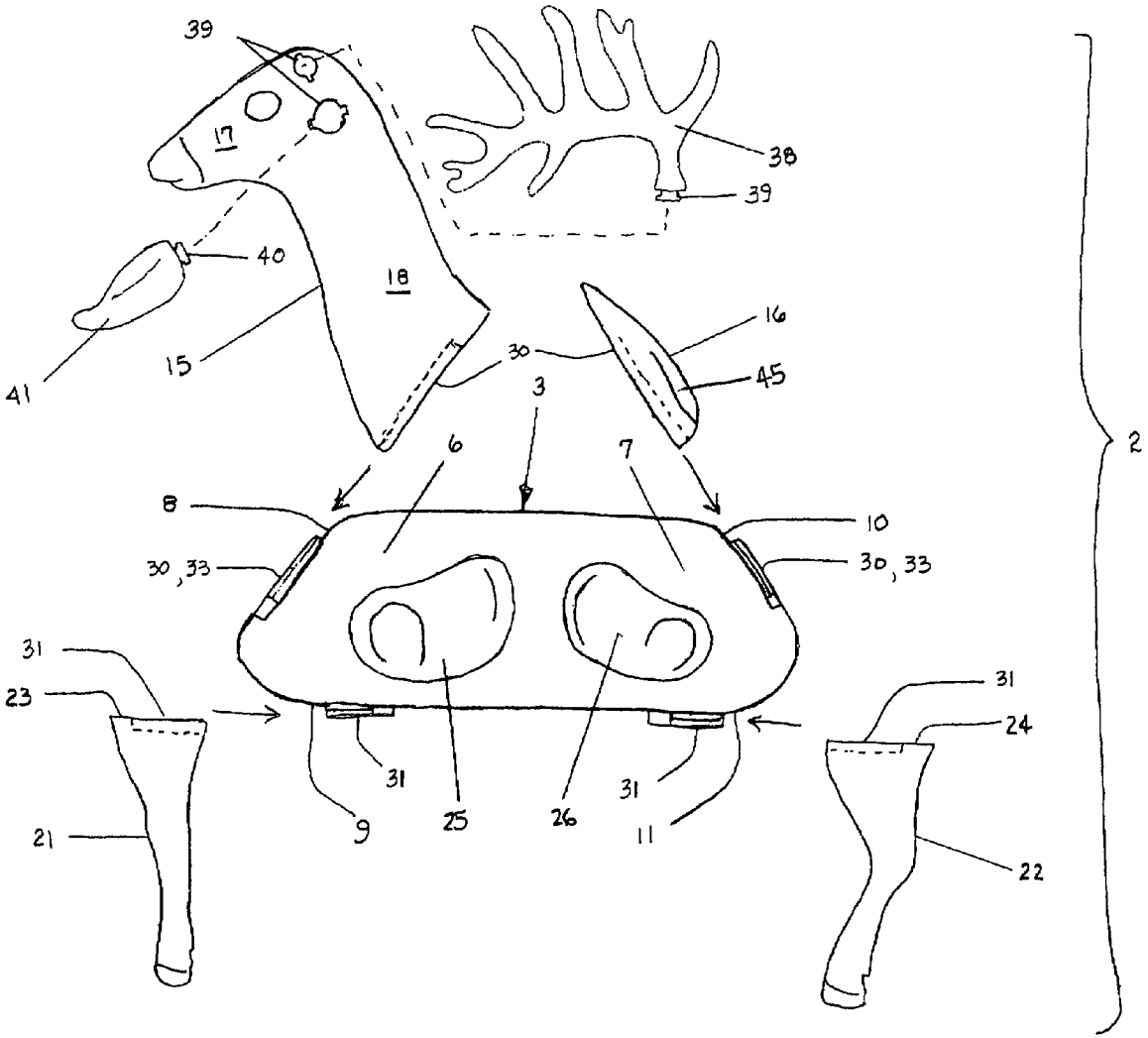
FIG. 2 is an exploded side view of the three-dimensional archery target as shown in FIG. 1.
Figure 4:
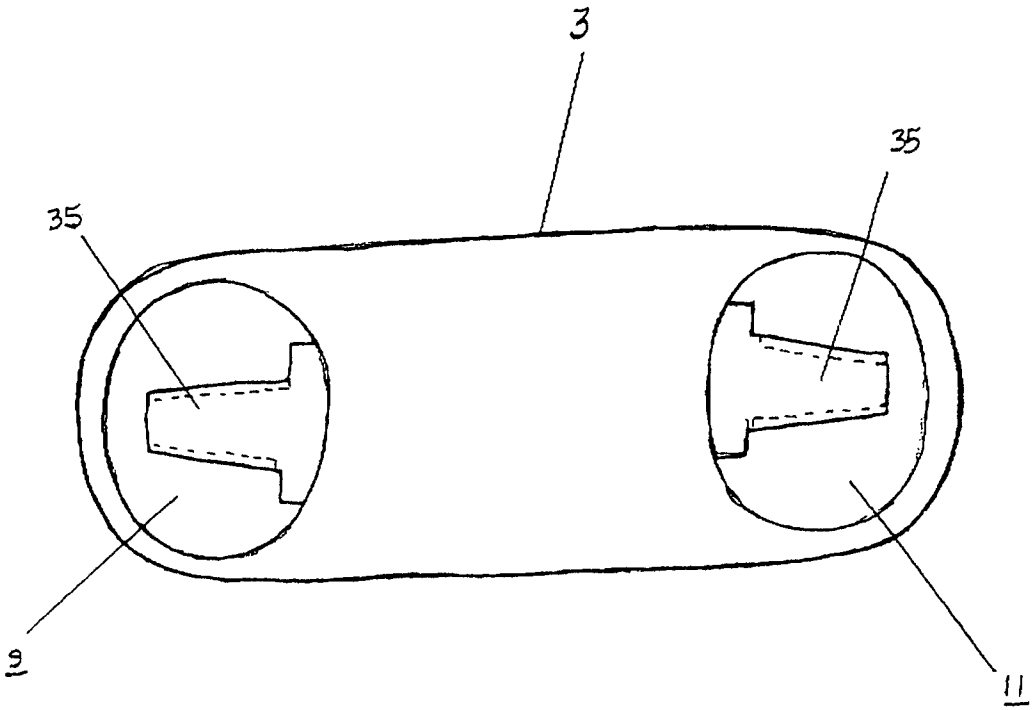
FIG. 4 is a bottom view of the central body of the three-dimensional archery target of FIG. 1.
Figure 6:
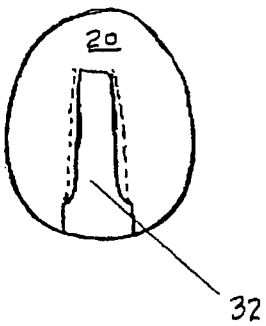
FIG. 6 is a front view of the rear section of the three-dimensional archery target shown in FIG. 1.
Figure 5:
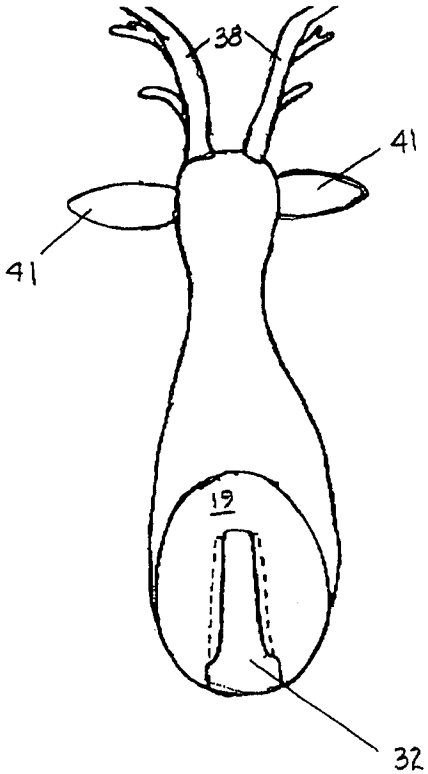
FIG. 5 is a rear view of the front section of the three-dimensional archery target of FIG. 1.

Referring to FIGS. 2 and 4, the central body section (3) is comprised of first (6) and second (7) body portions. The first body portion (6) has first (8) and second (9) abutment surfaces and the second body portion (7) has third (10) and fourth (11) abutment surfaces.

The interchangeable end sections (12) include a front end section (15), and a rear end section (16). The front end section (15) is characterized by a simulated animal head (17), a simulated animal neck (18) and a front abutment surface (19), while the rear end section (16) includes a simulated animal tail (45) and a rear abutment surface (20).

Figure 3B:
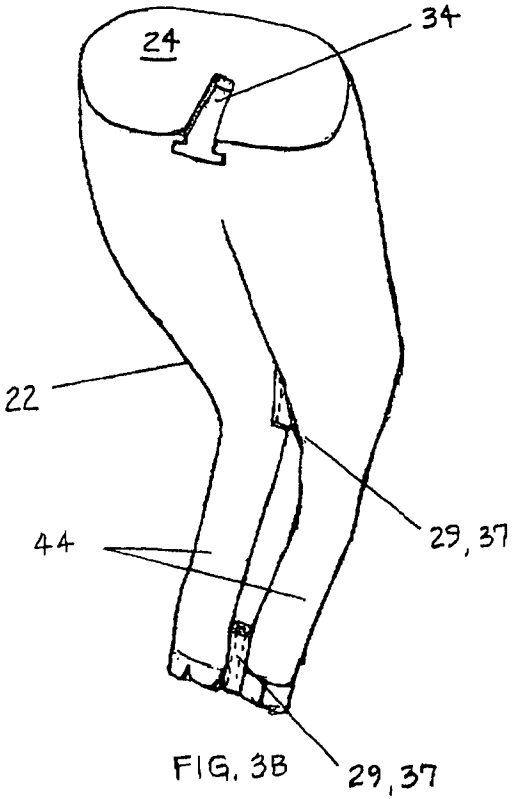
FIG. 3B is a perspective view of the second leg section of the three-dimensional archery target of FIG. 1.
Figure 3A:
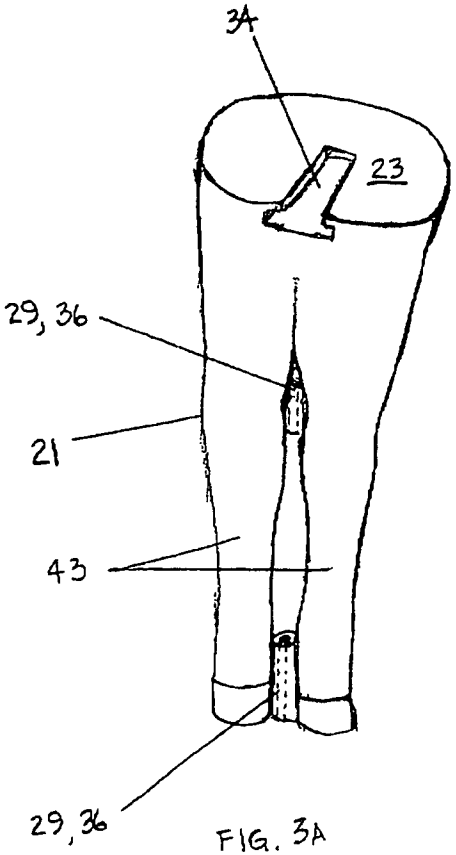
FIG. 3A is a perspective view of the first leg section of the three-dimensional archery target of FIG. 1.

Comprising the interchangeable leg sections (13) are first (21) and second (22) leg sections shown in FIGS. 2, 3A and 3B. The first (21) and second (22) leg sections include a pair of respective front (43) and rear (44) legs which simulate the legs of the selected simulated animal. The first leg section (21) has a front leg abutment surface (23) and the second leg section (22) has a rear leg abutment surface (24).

The removable head accessories (14) include a pair of antlers (38) and a pair of ears (41). The antlers (38) can be removed or attached to change the appearance of the simulated animal.

Each of the primary target zones (4) includes a first (25) and second (26) target area. One of the primary target zones (4) is positioned on one side of the target body (1) and the other target zone (4) is positioned on the opposite side. Therefore, a first target area (25) and a second (26) target area are disposed on each side of the central body section (3) in the respective first (6) and second (7) body portions of the archery target (100) shown in FIGS. 1 and 2. Each of these target areas (25,26) can be selectively positioned in a potential "kill" zone of the simulated animal. In a preferred embodiment, the target areas (25,26) are indicated on the central body section (3) using a distinguishing color pattern, an indentation, a printed diagram, or the like on the surface.

Referring to FIGS. 1, 3A-B and 9, the body support (5) is means for supporting the target body and comprises an H-shaped base (28) having a pair of posts (27) extending upwardly from the H-shaped base (28). A pair of first sleeves (36) are disposed on the first leg section (21) and a pair of second sleeves (37) are disposed on the second leg section (22). The first (36) and second (37) sleeves comprise means for releasably attaching the target body to the body support.

As shown in FIGS. 2-6, the target body (1) further comprises means for releasably attaching the end sections to the central body section, means for releasably attaching the leg sections to the central body section, and means for releasably attaching the head accessories to an interchangeable end section.

The means for releasably attaching the end sections to the central body section is a pair of releasable end section connectors (30) and the means for releasably attaching the leg section to the central body section is a pair of releasable leg section connectors (31).

In a preferred embodiment, each of the releasable end section connectors (30) comprises a dovetail joint. Each dovetail joint of the releasable end section connectors (30) includes an end groove (32) and an interlocking end protrusion (33). The interlocking end protrusion (33) cooperates with an end groove (32) to lock the respective end section (15,16) to the central body section (3). An interlocking end protrusion (33) is disposed on each of the first abutment surface (8) and the third abutment surface (10) of the central body section (3). An end groove (32) is disposed on the front abutment surface (19) of the front end section (15) and another end groove (32) is disposed on the rear abutment surface (20) of the rear end section (16). The end grooves (32) can be engaged with either of the interlocking end protrusions (33), thereby allowing the front (15) and rear (16) end sections to be interchangeably mounted on the first (6) and second (7) body portions of the central body portion (3). Consequently, the positions of the head (17) and tail (45) of the simulated animal can be reversed on the central body section (3).

Each of the releasable leg section connectors (31) are preferably comprised of a dovetail joint which includes a leg groove (34) and an interlocking leg protrusion(35). One of the interlocking leg protrusions (35) is disposed on the second abutment surface (9) of the first body portion (6) and the other of the interlocking leg protrusions (35) is disposed on the fourth abutment surface (11) of the second body portion (7) of the central body section (3). Each leg groove (34) cooperates with each of the interlocking leg protrusions (35) to secure the respective leg section (21,22) to the central body section (3).

The means for releasably attaching the head accessories to the central body section are a plurality of interlocking accessory connectors (42). Each interlocking accessory connector (42) includes a slotted opening (39) and a cooperating inter-engaging projection (40). A plurality of slotted openings (39) are disposed on the simulated animal head (17). Each of the antlers (38) and ears (41) include an inter-engaging projection (40) thereon. Consequently, an inter-engaging projection (40) can be secured within a slotted opening (39) to attach a selected head accessory (14) to the simulated animal head (17).

The three-dimensional archery target (100) is generally life-sized and shaped to resemble an animal. In the preferred embodiment, the animal simulated is a deer. However, any desired animal shape, such as elk, moose, coyote, cat, fox, sheep, caribou, goat, wolf, antelope, pig, bison, boar, impala, hyena, and bear, may be simulated instead.

The central body section (3) is generally symmetrical, both longitudinally and bilaterally. The first (6) and second (7) body portions are similar in size and shape. The abutment surfaces (19,20) on the interchangeable leg (21,22) and end (15,16) sections generally coincide with the size and shape of the first (8) and third (10) abutment surfaces on the central body section (3). Likewise, the front (23) and rear (24) leg abutment surfaces coincide generally with the size and shape of the second (9) and fourth (11) abutment surfaces on the central body section (3). The abutment surfaces (8,9,10,11,19,20,23,24) are generally planar. This ensures a snug fit when the archery target (1) is assembled for use.

In an alternative embodiment, the central body section (3) can be formed as separate parts that are releasably attached to form a unitary element.

In a preferred embodiment, the central body section (3) is made of polyurethane which is a suitable material having moldable characteristics with sufficient thickness and density to allow limited penetration and withdrawal of projectiles such as arrows. The leg sections (21,22) in the preferred embodiment are comprised of polyethylene (PE) and are more rigid than the polyurethane central body section (3). This makes the leg sections (21,22) flexible and strong enough to withstand arrow penetrations in those sections (21,22). Although it is preferred that the leg sections (21,22) are made of polyethylene, other suitable materials could be used instead. Preferably polyurethane is used, for the central body section (3), but materials such as polystyrene, polypropylene and the like may also be used instead.

In another preferred embodiment, each of the target areas (25,26) is made of a suitable material that is more durable than the material used to form the target body segments (2). Consequently, each target area (25,26) is able to withstand more arrow penetrations and withdrawals than the rest of the target body (1).

In another preferred embodiment, the archery target (100) has target areas (25,26) that are comprised of replaceable inserts. The inserts are removable from the central body section (3). The replaceable inserts can be made of various suitable materials selected for penetration resistance by an arrow. The material can also be selected for the particular arrow point used for target practice. For example, it is preferable that the insert be made of foam when using a broadhead arrow tip for practice shooting. The foam is instrumental to block the arrow from passing through the archery target. One suitable foam for comprising the insert is two to nine lbs/cu/ft ETHAFOAM, which is a foamed plastic of expanded synthetic resin. Preferably, the insert comprises six lbs/cu/ft ETHAFOAM.

In another preferred embodiment for use with field or target point arrows, each target area (25,26) is an insert comprised of compressed packing materials contained in a case comprised of coarse weave fabric such as burlap. Suitable packing materials for the insert include cloth pieces, rags, burlap bags, fabric scraps and cotton molt. When damaged, the replaceable insert of the primary target zone can be removed from the central body section and another insert placed in the archery target. Replacing the damaged insert in the target area can extend the useable life of the archery target.

Each of the first (25) and second (26) target areas of the primary target zone (4) on the three-dimensional archery target (100) coincides with a designated area on an actual animal that approximates the location of the heart and lungs. Such a hit on the designated area of an animal will most likely result in a kill. Therefore, the primary target zone (4) represents an ideal location for aiming when target shooting.

The shoulder and flank areas of the central body section (3) can alternate between functioning as a flank and a shoulder on the simulated animal represented by the three-dimensional archery target (100). The function of the respective first (6) and second (7) body portions is dependent upon the position of the interchangeable leg (21,22) and end (15,16) sections on the central body section (3).

The interchangeable leg (21,22) and end (15,16) sections are releasably secured to the central body section (3) such that the front end section (15) is attached to one of the first (6) or second (7) body portions and the rear end section (16) is attached to the other of the first (6) or second (7) body portions.

By reversing the positions of the front (15) and rear (16) end sections and the positions of the first(21) and second (22) leg sections on the central body section (3), the front and rear of the target body (1) is reversed. By reversing the target body (1), the target areas (25,26) representing the "kill zone" on the simulated animal can be alternated. In addition, a user can alternate between shooting at the primary target zones (4) on the left and right sides of the target body (1).

When the front end section (15) is attached to the first body portion (6) the front abutment surface (19) is adjacent to the first abutment surface (8) with one of the releasable end section connectors (30) engaged such that the interlocking end protrusion (33) on the first abutment surface (8) is disposed in the end groove (32) on the front end section (15). With the front end section (15) attached to the first body portion (6) as such, the rear end section (16) is attached to the second body portion (7), whereby the rear abutment surface (20) is adjacent to the third abutment surface (10). In this position, the releasable end section connector (31) is engaged so that the end groove (32) on the rear end section (16) is releasably engaged with the interlocking end protrusion (33) on the second body portion (7). In addition, the first leg section (21) is attached to the first body portion (6) such that the front leg abutment surface (23) is adjacent to the second abutment surface (9) and the leg groove (34) on the first leg section (21) is engaged with the interlocking leg protrusion (35) on the first body portion (6). The second leg section (22) is attached to the second body portion (7) with the leg interlocking protrusion (35) on the fourth abutment surface (11) engaging the leg groove (34) on the rear leg abutment surface (24) and the fourth (11) and rear leg (24) abutment surfaces being adjacent one another.

Alternately, the front end section (15) and the rear end section (16) can be interchanged on the central body section (3) so that the front end section (15) is releasably attached to the second body portion (7) and the rear end section (16) is releasably attached to the first body portion (6). With these front (15) and rear (16) end sections interchanged, the front abutment surface (19) is disposed adjacent to the third abutment surface (10) and the rear abutment surface (20) of the rear end section (16) is disposed adjacent to the first abutment surface (8). It follows that the end groove (32) on the front end section (15) is engaged with the interlocking end protrusion (33) on the second body portion (7) and the end groove (32) on the rear end section (16) is engaged with the interlocking end protrusion (33) on the first body portion (6). Also, the first leg section (21) is attached to the second body portion (7) and the second leg section (22) is attached to the first body portion (6). The leg groove (34) of the first leg section (21) is engaged with the interlocking leg protrusion (35) of the second body portion (7) and the leg groove (34) of the second leg section (22) is engaged with the interlocking leg protrusion (35) of the first body portion (6).

The body support (5) comprises means for supporting the target body. The H-shaped base (28) of the body support (5) is adapted for positioning on a supporting surface with the posts (27) extending generally upwardly and away from the base (28). The means for releasably attaching the support to the target body are disposed on the leg sections (21,22) and are engaged by the body support (5), such that the sleeves (36,37) on one of the leg sections (21,22) are fitted onto one of the posts (27). Preferably the sleeves (36,37) on the other leg section (21,22) are fitted onto the other of the posts (27). Specifically, the first sleeves (36) are fitted onto one of the posts (27) and the second sleeves (37) can be fitted onto the other of the posts (27) to secure the target body (1) onto the body support (5).

The first (25) and second (26) target areas of each side are positioned on the central body section (3) and can be alternately designated as "kill" zones by reconfiguring the target body (1). In one configuration, the first target area (25) is disposed on the first body portion (6) while the second target area (26) is disposed on the second body portion (7). When the front end section (15) is disposed on the first body portion (6) of the central body section (3) and the rear end section (16) is disposed on the second body portion (7), the first target area (25) represents the area where the heart and lungs or "kill" zone of the simulated animal is generally located.

Alternately, the front end section (15) can be disposed on the second body portion (7) and the rear end section (16) can be disposed on the first body portion (6). In this alternate configuration, the second target area (26) then represents the "kill" zone where the heart and lungs of the simulated animal are generally located.

During use, the three-dimensional archery target (100) functions to receive projectiles, such as arrows, therein. The target area (25,26) of the primary target zone (3) that is closest to the front end section (15) represents the "kill" zone. After use in this configuration and resultant damage to the target area (25,26) being utilized, the front (15) and rear (16) end sections may be interchanged on the central body section (3).

For example, when the front end section (15) with the simulated animal head (17) is disposed on the first body portion (6) and the rear end section (16) with the simulated animal tail (45) is disposed on the second body portion (17), the "kill" zone is represented by the first target area (25). When the front end section (15) is subsequently moved to the second body portion (7) and the rear end section (16) is moved to the first body portion (6), the front to back orientation of the target body (1) is reversed. Reversing the orientation of the target body (1) also changes the designated "kill" zone represented on the archery target (100). Therefore, with the front end section (15) being repositioned onto the first body portion (6) and the rear end section (16) being repositioned onto the first body portion (6) of the central body section (15), the "kill" zone changes from the first target area (25) to the second target area (26) and the first target area (25) is no longer the designated "kill" zone.

By readily changing the designated "kill" zone on the target body (1), the three-dimensional archery target (100) of the present invention can endure at least twice the amount of arrow penetration and withdrawal that a single target can otherwise withstand, thereby extending the useable life of the target. Also, with the three-dimensional archery target (100), a primary target zone (4) is disposed on each side of the target body (1), thus enhancing the usage potential of the target body (1).

Due to the interchangeability of the target body segments (2), the target (100) can comprise at least two different configurations, namely first and second configurations. In the first configuration, the front end section (15) is attached to the first body portion (6) and the rear end section (16) is attached to the second body portion (7). The first leg section (21) is attached to the first body portion (6) and the second leg section (22) is attached to the second body portion (7). The first target areas (25) on the first body portion(6) are the designated "kill" zones on the central body section (3).

In the second configuration for the target (100), the front and back orientation of the target are reversed from that of the first configuration. The front end section (15) is attached to the second body portion (7) and the rear end section (16) is attached to the first body portion (6). The first leg section (21) is attached to the second body portion (7) and the second leg section (22) is attached to the first body portion (6). The second target areas (26) located in the second body portion (7) become the designated "kill" zone for the target (100).

Figure 8:
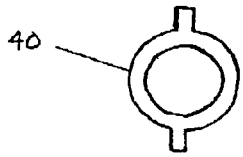
FIG. 8 is a cross sectional view of the connector on the antler of the three-dimensional archery target taken along line A-A in FIG. 6.
Figure 7:
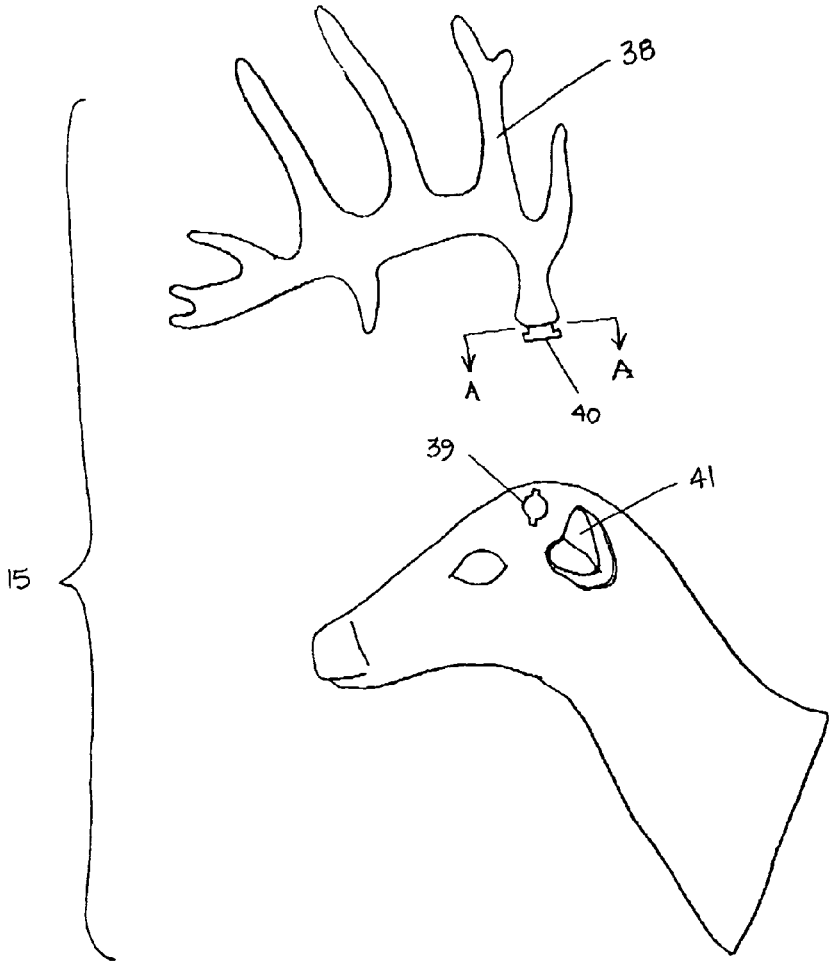
FIG. 7 is a side view of the front section of the three-dimensional archery target of FIG. 1 with the antlers being removed.
Figure 9:
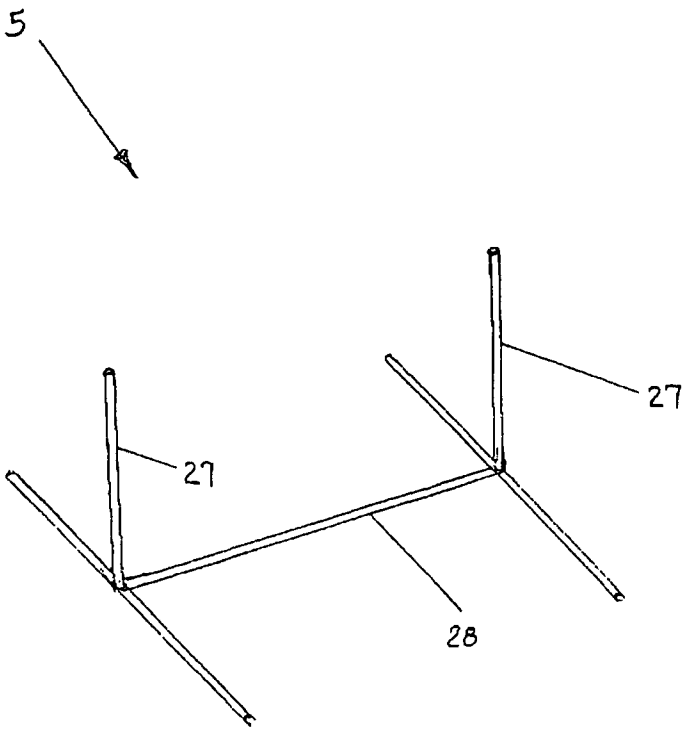
FIG. 9 is a perspective view of the body support of the three-dimensional archery target of FIG. 1.

In an alternate embodiment shown in FIG. 7, the front end section (15) of the archery target (100) can be simulated to depict characteristics or a particular gender of the desired game, such as the head of a doe instead of a buck. By using a head that represents the particular characteristics or gender of the game animal, the hunter can develop a practiced response to the target that can be applied when faced with the actual animal in the field. Such a practiced response can improve the performance of the hunter. To simulate a doe, for example, the antlers (38) are removed from the front end section (15) as shown in FIGS. 7 and 8. The interlocking accessory connection (42) comprising the slotted opening (39) on the front end section (15) and the inter-engaging projection (40) on the antlers (38) allows for releasably connecting the antlers (38) to the head (17) of the target's simulated animal. Therefore, the life-like archery target (100) of the present invention can provide different target configurations to resemble different animal forms to enhance a user's practice experience.

Although the present invention has been described in considerable detail with reference to certain preferred versions thereof, other versions are possible. Therefore, the spirit and scope of the specification and appended claims should not be limited to the description of the preferred versions contained herein.

The invention claimed is:

1. A three-dimensional archery target of a simulated animal, the three-dimensional archery target comprising:

a target body (1); and a body support (5);

said target body (1) including:

a plurality of target body segments (2); and a plurality of primary target zones (4) disposed on the target body segments (2), wherein one of said plurality of primary target zones (4) is disposed on one side of said target body (1) and another of said primary target zones (4) is disposed on an opposite side of said target body (1);

said target body segments (2) include:

a central body section (3) having first (6) and second (7) body portions, wherein said first body portion (6) includes first (8) and second (9) abutment surfaces; and said second body portion (7) includes third (10) and fourth (11) abutment surfaces;

a plurality of interchangeable end sections (12) having front (15) and rear (16) end sections; wherein said front end section (15) comprises a simulated animal head (17) and neck (18); and said rear end section (16) comprises a simulated animal tail (45); said front end section (15) further comprising a front abutment surface (19) being generally planar and said rear end section (6) further comprising a rear abutment surface (20) being generally planar; and a plurality of interchangeable leg sections (13) having first (21) and second (22) leg sections, wherein said first leg section (21) having a front leg abutment surface (23), a pair of front legs (43), and a plurality of first sleeves (36); and said second leg section (22) having a rear leg abutment surface (24), a pair of rear legs (44), and a plurality of second sleeves (37); and a plurality of removable head accessories (14) which include a pair of antlers (38); said primary target zones (4) include:

a first target area (25) positioned on said first body portion (6) of the central body section (3); and a second target area (26) positioned on said second body portion (7) of the central body section (3);

wherein said first (25) and second (26) target areas are alternately designated kill zones on the simulated animal comprising the target (100);

said target body (1) further comprising:

a plurality of releasable end section connectors (30); and a plurality of releasable leg section connectors (31);

each of said releasable end section connectors (30) having an end groove (32) and an interlocking end protrusion (33) for releasably engaging the end groove (32);

wherein one of said end grooves (32) is disposed on said front abutment surface (19) of said front end section (15) and another of said end grooves (32) is disposed on said rear abutment surface (20) of said rear end section (16); and one of said interlocking end protrusions (33) is disposed on said first abutment surface (8) on said first body portion (6) and another of said interlocking end protrusions (33) is disposed on said third abutment surface (10) on said second body portion (7) of the central body section (3);

wherein one of said end grooves (32) releasably engages the interlocking end protrusions (33) on one of said first (8) and third (10) abutment surfaces and the other of said end grooves (32) releasably engages the interlocking end protrusions (33) on the other of said first (8) and third (10) abutment surfaces, whereby said front (15) and rear (16) end sections can be selectively attached to the central body section (3) and alternated between positions on the first (6) and second (7) body portions;

each of said releasable leg section connectors (31) having a leg groove (34) and an interlocking leg protrusion (35); wherein one of said leg grooves (34) is disposed on said front leg abutment surface (23) on said first leg section (21) and another of said leg grooves (34) is disposed on said rear leg abutment surface (24) on said second leg section (22) of said interchangeable leg sections (13); and one of said interlocking leg protrusions (35) is disposed on said second abutment surface (9) on said first body portion (6) and the other of said interlocking leg protrusions (35) is disposed on said fourth abutment surface (11) on said second body portion (7) of said central body section (3); wherein one of said leg grooves (34) releasably engages the interlocking leg protrusion (35) on one of said second (9) and fourth (11) abutment surfaces, and the other of said leg grooves (34) releasably engages said interlocking leg protrusion (35) on the other of said second (9) and fourth (11) abutment surfaces to selectively attach the first (21) and second (22) leg sections to said central body section (3);

said body support (5) comprises means for supporting the target body;

wherein said means for supporting the target body comprises an H-shaped base (28) and a pair of posts (27) extending outwardly from said H-shaped base (28);

wherein said posts (27) are received within said plurality of sleeves (29) such that one of said posts (27) is positioned within said first sleeves (36) on said first leg section (21) and another of said posts (27) is positioned within said second sleeves (37) on said second leg section (22)

whereby said first (21) and second (22) leg sections can be selectively attached to the central body section (3) and alternated between positions on the first (6) and second (7) body portions to thereby reconfigure the target body segments (2) and reverse orientation of the first (6) and second (7) body portions and the first (25) and second (26) target areas relative to the head (17) and tail (45) of the simulated animal; and said target further comprising first and second configurations, wherein in said first configuration the front end section (15) is attached to the first body portion (6), the rear end section (16) is attached to the second body portion (7), the first leg section (21) is attached to the first body portion (6) and the second leg section is attached to the second body portion (7); and wherein in the second configuration the front end section (15) is attached to the second body portion (7), the rear end section is attached to the first body portion (6), the first leg section (21) is attached to the firsts body portion (6) , and the second leg section (22) is attached to the first body portion (6).

2. The three-dimensional archery target of claim 1, further comprising a plurality interlocking accessory connectors (42), each interlocking accessory connector (42) includes a slotted opening (39) and an inter-engaging projection (40);

wherein said plurality of slotted openings (39) are disposed on the simulated animal head (17) of the front end section (15); one of said inter-engaging projections (40) is disposed on each of said antlers (38); and said inter-engaging projections (40) are interlocked with the slotted openings (39) to removably attach each of the antlers (38) to a selected slotted opening (39) on the simulated animal head (17);

wherein said target body (1) can be alternated between one configuration having antlers (38) attached to the simulated animal head (17) and another configuration having the antlers (38) removed, so that the target (100) can alternately resemble a buck and a doe, respectively.

* * * * *